US005911740A

United States Patent [19]

Tunkel et al.

[11] Patent Number: 5,911,740

[45] Date of Patent: Jun. 15, 1999

[54] METHOD OF HEAT TRANSFER ENHANCEMENT IN A VORTEX TUBE

[75] Inventors: Lev Tunkel, Edison, N.J.; Boris Krasovitski, Nesher, Israel

[73] Assignee: Universal Vortex, Inc., Robbinsville, N.J.

[21] Appl. No.: 08/976,329

[22] Filed: Nov. 21, 1997

[51] Int. Cl.[6] ..... F25B 9/02

[52] U.S. Cl. ..... 62/5; 62/87; 62/401

[58] Field of Search ..... 62/5, 87, 401

[56] References Cited

U.S. PATENT DOCUMENTS

| | | | |
|---|---|---|---|
| 3,152,475 | 10/1964 | Ford, Jr. et al. | 62/5 |
| 3,160,490 | 12/1964 | Fabre et al. | 62/5 |
| 3,455,117 | 7/1969 | Prelowski | 62/5 |
| 4,302,949 | 12/1981 | Longhetto | 62/5 |
| 4,584,838 | 4/1986 | AbuJudom II | 62/5 |

*Primary Examiner*—Ronald Capossela
*Attorney, Agent, or Firm*—McAulay Nissen Goldberg Kiel & Hand, LLP

[57] ABSTRACT

A method of heat transfer enhancement in the vortex tube harnessed in a system including a vortex tube with its slender tube plugged at the far end, fins attached to the slender tube's outer side and a shell and comprising the steps of: enclosing the finned vortex slender tube with the shell, thus forming an outer wall of the heat exchanger; connecting a vortex tube's inlet with the source of compressed gas and then discharging the gas flow through vortex tube's diaphragm, thus providing for the gas flow to undergo an energy separation in the vortex tube; and connecting a separate gas flow with the heat exchanger inlet and then discharging this flow from the heat exchanger outlet, thus providing for the vortex flow to cool down and for the heat exchanger's flow to heat up. The invention is also concerned with a method of heat transfer wherein the vortex tube operates with condensed in the chilled vortex flow gas mixture's components, and includes a preliminary heat exchanger, a separator, a vortex tube with its slender tube having a throttle valve at its far end, fins attached to the slender tube's outer side and the shell, and the steps include connecting a preliminary heat exchanger inlet with a source of the compressed gas; connecting a vortex tube's inlet with the outlet of the preliminary heat exchanger and then discharging the gas flow through vortex tube's diaphragm, thus providing for the gas flow to undergo an energy separation in the vortex tube; directing a portion of the gas flow exiting diaphragm discharge opening through an adjusting valve to the heat exchanger inlet and then discharging this flow from the heat exchanger, thus providing for the flow in the vortex tube gradually cool down; directing another portion of the gas flow exiting diaphragm discharge opening through an adjusting valve to the preliminary heat exchanger's inlet and then discharging this flow from the preliminary heat exchanger, thus also providing for the flow in the vortex tube gradually cool down; combining gas flows exiting both heat exchangers; and directing a gas flow downstream of the throttle valve to the separator to recover a condensed liquid.

16 Claims, 2 Drawing Sheets

METHOD OF HEAT TRANSFER ENHANCEMENT IN A VORTEX TUBE

BACKGROUND OF THE INVENTION

Field of the Invention

This invention is concerned with vortex tubes. More particularly, the present invention relates to a method of a vortex tube energy separation efficiency increase.

DESCRIPTION OF THE PRIOR ART

It is known to use a vortex tube for an energy separation when the vortex tube is fed with a compressible fluid under a positive (e.g., above atmospheric) pressure. In a vortex tube, the initial flow is transformed into two separate currents of a different internal energy (a cold and a hot fraction) leaving the vortex tube under a pressure which is less than the inlet pressure, but at a pressure still above atmospheric.

A vortex tube comprises a slender tube with a diaphragm closing one end of the tube provided with a hole in the center of the diaphragm for discharge of the cold fraction, one or more tangential inlet nozzles piercing the tube just inside of the diaphragm, and a controlled hot fraction discharge opening such as a throttle valve or any other restrictive body at the far end or the other end of the slender tube.

For the sake simplicity in the use of terms, the term "throttle" will be used hereinafter in a broad sense to define a controlled hot fraction discharge opening, a restrictive body or a throttle valve.

Even today, the full theory of the vortex tube, explaining all its features, has not yet been created or established. However, the principal mechanism of the vortex phenomenon can be described in the following manner. An expending gas after passing the tangential nozzle develops into a high speed rotating body or a vortex. The gas in the vortex is cooled because part of its total energy converts into kinetic energy. An angular velocity in the vortex is low at the periphery zone and very high toward the center zone. Friction between the central and periphery zones reduces all the gas to the same angular velocity as in a solid body. This causes the inner layers to slow down and the outer layers to speed up. As a result, the inner layers lose part of their kinetic energy and their total temperature decreases. The periphery layers receive the energy from the internal layers. This energy converts to heat through friction on the vortex tube's walls. The vortex tube's cooling efficiency may be increased with the provision of the heat transfer outside the vortex tube's wall. This leads to reduction of the hot fraction actual temperature and accordingly to a reduction of a heat flow directed, due to the gas heat convection and conductivity, from the vortex periphery to the vortex center (opposed to the flow of kinetic energy).

Obviously, the best result with this approach may be obtained with such vortex tube's mode of operation which features the largest temperature gradient in the swirling flow. In this case, the largest heat flux might be transferred outside the vortex tube's walls.

We have found both theoretically and experimentally that the largest temperature gradient is typical for the vortex tube operating with its throttle valve on the far end of the slender tube completely closed.

In means that at this mode of operation the internal (cold) and the external (hot) vortex layers, prior to its mixing up at the vortex tube's diaphragm discharge opening, have, accordingly, the lowest and highest value of their absolute temperature.

SUMMARY OF THE INVENTION

To this end, the present invention consists in the provision of the heat flux transfer outside of the vortex tube's wall, which results in the reduction of the heat flux from the vortex tube periphery to the vortex chilled central layers.

DETAILED DESCRIPTION OF THE PREFERRED EMBODIMENTS

Figure 1:
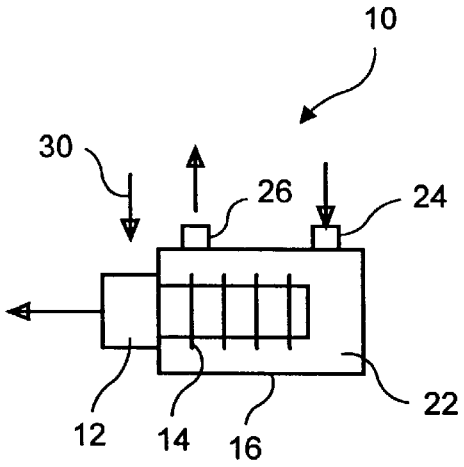
FIG. 1 is a schematic design and flow diagram of one embodiment according to the invention.

With reference to FIGS. 1 to 4 of the accompanying drawings directed to the method of heat transfer enhancement in the vortex tube and, in particular, to the schematic design and flow diagram of FIG. 1 which illustrates one embodiment of the present invention, an assembly 10 providing for the heat transfer enhancement in the vortex tube includes a vortex tube 12 with its slender tube plugged at the far end, fins 14 attached to the slender tube's outer side and a shell 16 which encloses a finned slender tube thus forming an outer wall of the heat exchanger 22.

A gas flow enters assembly 10 in the direction of arrow 30 through the vortex tube's nozzles and then undergoes an energy separation.

A separate gas flow or a liquid enters the heat exchanger 22 through its inlet opening 24 and then, moving to the outlet opening 26 alongside the finned vortex tube's outer surface, picks up heat transferred from the hot vortex layers to the vortex tube's finned outer walls. As a result of the energy transfer, the vortex combined flow (cold internal layers and cooled external layers) leaves the vortex tube's diaphragm with the temperature substantially lower than the vortex tube's inlet flow temperature, while the flow leaving the heat exchanger has a temperature substantially higher than the heat exchanger's inlet flow temperature. Thus, the method according to the flow diagram of FIG. 1 may be used multi-purposely: for gas stream(s) cooling, heating or cooling and heating.

As a supplementary measure to decrease a heat flux toward the vortex central layers, a liquid can be injected into the vortex tube's inlet. This liquid being forced to the tube's hot walls by the swirling flow's high centrifugal forces, then in the hot gas flow warms up or even evaporates, thus reducing the vortex outer flow's temperature.

Another area of technology in connection with this embodiment and with the other embodiments in FIGS. 1 to 4 also provides for the interchange of inlet opening 24 and outlet opening 26 such that the gas or the liquid can be arranged to enter into heat exchanger 22 through opening 26 which then becomes an inlet opening and the gas or the liquid exits from heat exchanger 22 through opening 24 which then becomes an outlet opening.

Figure 2:
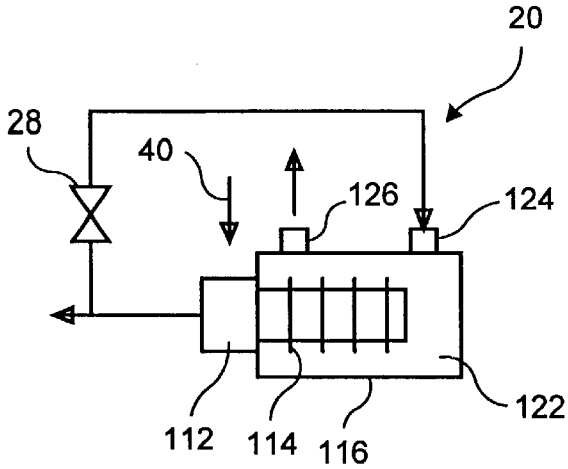
FIG. 2 is a schematic design and flow diagram of another embodiment of the invention.

Another embodiment of the present invention allowing to obtain very low temperatures for the portion of the gas discharged from the vortex tube's diaphragm is shown in FIG. 2. In this embodiment, parts similar to the parts in FIG. 1 have been raised by 100.

As shown on the schematic design and flow diagram of FIG. 2, an assembly 20 for the heat transfer enhancement in the vortex tube includes a vortex tube 112 with its slender tube plugged at the far end, fins 1 14 attached to the slender tube's outer side and a shell 116 which encloses the finned slender tube thus forming an outer wall of the heat exchanger 122.

A gas flow in the direction of arrow 40 enters assembly 20 through the vortex tube's nozzles and then undergoes an energy separation.

A combined flow leaving the vortex tube's diaphragm is then divided. One portion through valve 28 which is set up to maintain a desirable flow rate is then directed to the heat exchanger's inlet opening 124. This flow takes the heat from the finned vortex tube's outer surface and then leaves the heat exchanger 122 through it's outlet opening 126.

In the FIG. 2 embodiment, as in the FIG. 1 embodiment, the heat exchanger's inlet flow opening and outlet flow opening can also be interchanged.

Another portion is a flow, which gradually (until a status of the heat transfer equilibrium is reached) gets colder and colder.

In a case when a vortex tube's inlet gas flow contains component(s) which may condense in the chilled vortex flow, another embodiment of the invention may be used.

Figure 3:
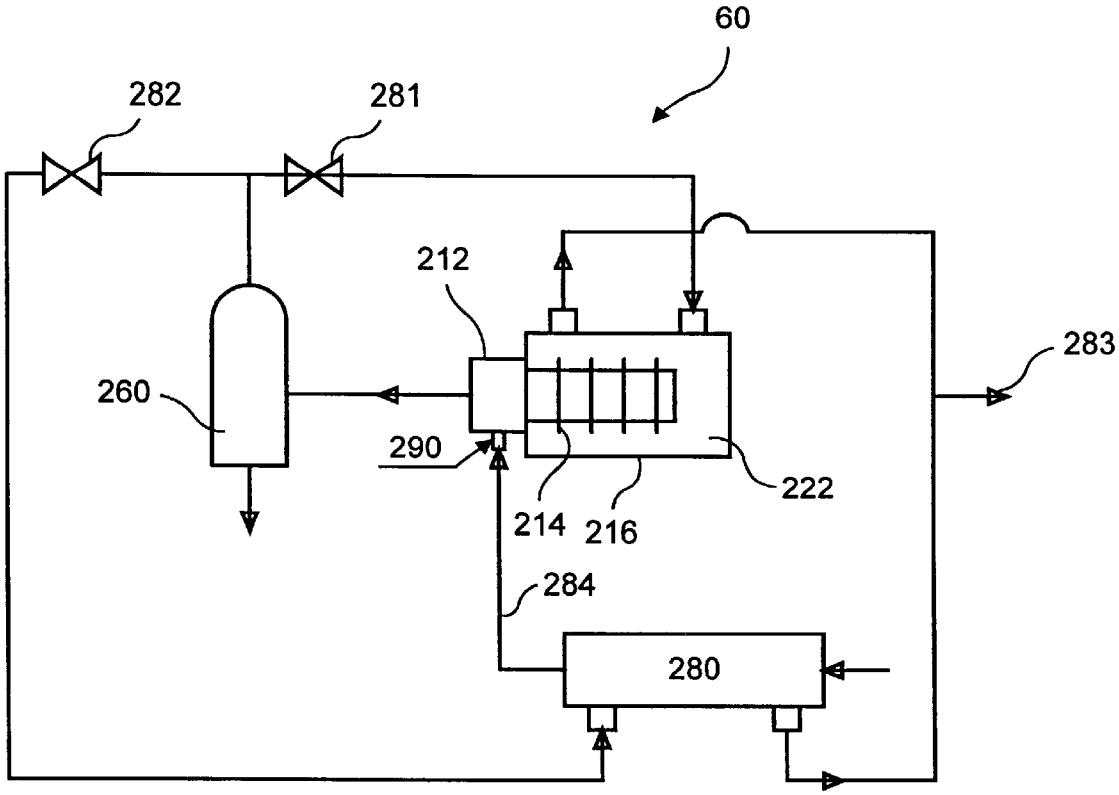
FIG. 3 is a schematic design and flow diagram of another embodiment of the invention.

As it is shown on the schematic design and flow diagram in FIG. 3, an assembly 60 to operate with the condensing components or condensate in the heat transfer enhanced vortex tube comprises a vortex tube 212 with its slender tube plugged at the far end, fins 214 attached to the slender tube's outer side, a shell 216, which encloses a finned slender tube thus forming an outer wall of the heat exchanger 222, a liquid/gas separator 260 connected with the vortex tube's outlet, and a heat exchanger 280 connected with the vortex tube's inlet.

An assembly 60 which is a Low Temperature Separation layout may be used for any gas composition treatment, providing there is at least one component in the mixture which vapor might be condensed in the chilled vortex flow. However, the main area of the presented embodiment application is an oil and gas industry, which operates with the hydrocarbonaceous mixtures composed with the components of the different fugacity.

A high pressure hydrocarbonaceous mixture enters assembly 60 through a heat exchanger 280 where gas is cooled by the vortex tube's outlet flow. Then the high pressure gas through line 284 enters vortex tube 212 where it undergoes an energy separation. In the chilled swirling gas flow a condensation of feed's saturated vapor (high hydrocarbons and water) takes place. If there are sour components in the feed, the $H_2S$ and/or $CO_2$ vapor(s) is easily get absorbed by the chilled condensed liquid (Low Temperature Absorption).

A low pressure gas/liquid mixture with the captured $H_2S$ and/or $CO_2$ (if any) is then discharged through the vortex tube's diaphragm to the separator 260 set up to recover liquid and prevent it from entering the heat exchanger. The liquid is then discharged from the bottom of the separator and directed to the storage base or to the treatment facility. The chilled upstream gas flow leaving the separator is then divided into two parts. One part through a valve 281 which is set up to maintain a desirable flow rate is directed to the heat exchanger 222 to cool down the vortex tube's walls (besides the vortex tube's heat transfer enhancement, and it also prevents a condensed liquid evaporate (e.g., prevents to decrease a recovered liquid output), and another part through a valve 282 is directed to the heat exchanger 280 to cool down an inlet gas flow.

A conditioned gas flow passing heat exchanger 222 and a conditioned gas flow passing heat exchanger 280 are then leaving an assembly 60 through a pipe 283.

The value of the gas flow directed into each heat exchanger depends on the wet gas operational parameters. If there is water available, it may be used in the heat exchangers 222 and 280 as a cooling medium. In this case, a conditioned gas flow goes directly from the separator 260 outlet to the pipe 283.

In general, both gas and water may be used for the cooling purposes in the following ways: water for the heat exchanger 222 and gas for the heat exchanger 280 or water for the heat exchanger 280 and gas for the heat exchanger 222.

In the natural gas operations a liquid to be injected into the vortex flow inlet should preferably be hydrocarbonaceous mixture or amine. Besides of the outer vortex flow's temperature decease, the liquid hydrocarbons provide an additional hydrocarbons vapor recovery, while amine captures $CO_2$ and $H_2S$ vapor. At this point an injection device 290 connected with the vortex tube 212 is included into assembly 60.

In some applications, a vortex tube is used for drying only a portion of the wet feed. In this case, a throttle on the slender tube's end is not closed.

In such a mode of operation, a saturated feed's vapor condensing in the vortex central chilled layers forms drops which, under the influence of swirling flow's high centrifugal forces, are forced to the vortex periphery and then, being mixed up with a hot flow, leave the vortex tube through a throttle.

A dried cold fraction with the dew point value close to the central layer's temperature leaves the vortex tube through a diaphragm.

A heat transfer enhancement in the vortex tube results in the lowering of the vortex center layers temperature/dew point. In addition, the vortex tube's walls cooling prevent a liquid in the hot flow evaporate.

Figure 3A:
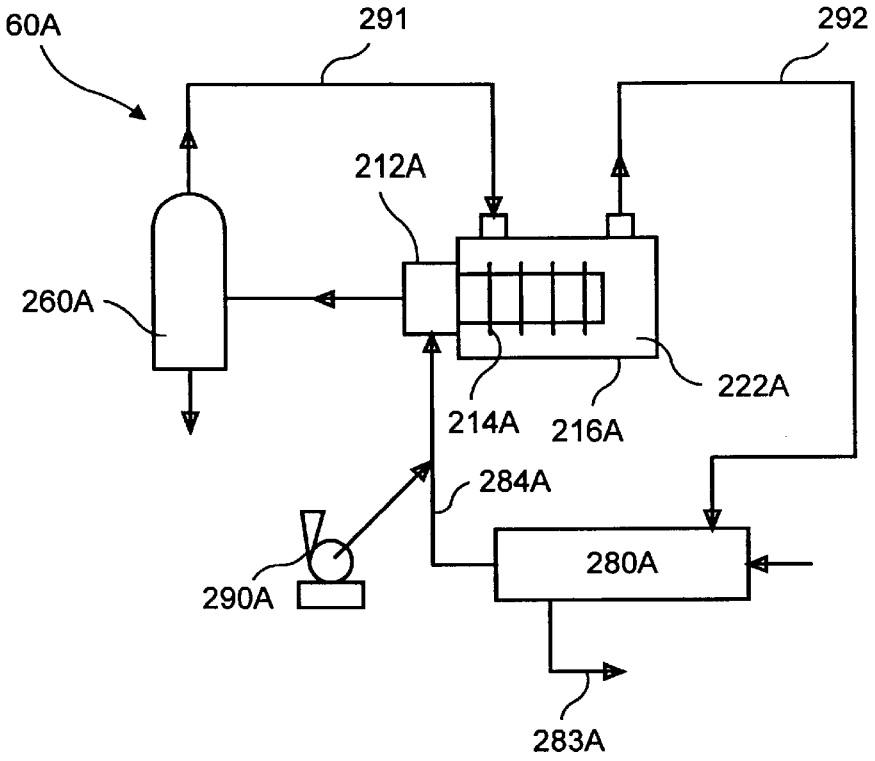
FIG. 3A is a schematic design and flow diagram of another embodiment of the invention.

FIG. 3A indicates that the apparatus of FIG. 3 can be connected in another but related matter, thus providing another low temperature separation layout for heavy hydrocarbons and sour components recovery. The apparatus in FIG. 3A has the same reference numerals as the apparatus in FIG. 3, but with the letter "A" added to the corresponding element in FIG. 3.

As it is shown on the schematic design and flow diagram in FIG. 3A, an assembly 60A to operate with the condensed components in the heat transfer enhanced vortex tube comprises a vortex tube 212A with its slender tube plugged at the far end, fins 214A attached to the slender tube's outer side, a shell 216A, which encloses a finned slender tube thus forming an outer wall of the heat exchanger 222A, a liquid/gas separator 260A connected with the vortex tube's outlet, and a heat exchanger 280A connected with the vortex tube's inlet.

High pressure hydrocarbons enter assembly 60A through heat exchanger 280A where gas is cooled by the vortex tube shell's outlet flow. Then the high pressure gas through line 284A enters vortex tube 212A where it undergoes an energy separation. In the chilled swirling gas flow a condensation of feed's saturated vapor (high hydrocarbons and water) takes place. If there are sour components in the feed, the $H_2S$ and/or $CO_2$ vapor(s), these easily get absorbed by the chilled condensed liquid (Low Temperature Absorption). A low pressure gas/liquid mixture with the captured sour components (if any) is then discharged through the vortex tube's diaphragm to the separator 260A. The liquid is then discharge from the bottom of the separator and directed to the storage base or to the treatment facility.

The chilled upstream gas flow leaving the separator is then directed through line 291 to the heat exchanger 222A to cool down the vortex tube's walls (besides the vortex tube's heat transfer enhancement, it also prevents a condensed liquid evaporate).

A conditioned gas flow passing heat exchanger 222A with the temperature still below an inlet gas temperature is then directed to the heat exchanger 280A through line 292 to cool down an inlet gas flow.

A conditioned gas flow passing heat exchanger 280A then leaves an assembly 60A through pipe 283A.

In the natural gas operation, a liquid is to be injected into the vortex flow inlet should preferably be a hydrocarbonaceous mixture or amine. Besides the outer vortex flow's temperature decrease, the liquid hydrocarbons provide an additional hydrocarbons vapor recovery, while the amine captures the $CO_2$ and $H_2S$ vapor. At this point, an injection device 290A connected with the vortex tube 212A is included into assembly 60A.

Figure 4:
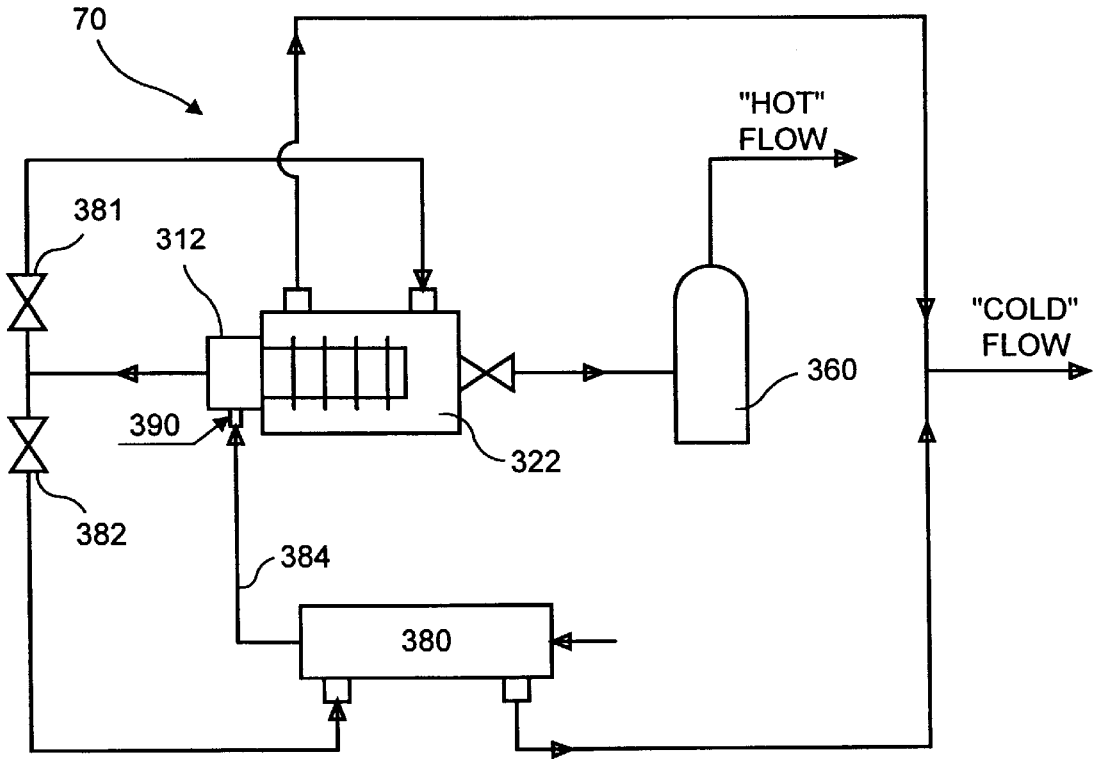
FIG. 4 is a schematic design and flow diagram of another embodiment of the invention.

As it is shown on the schematic design and flow diagram in FIG. 4, an assembly 70 to operate with condensing components in the heat transfer enhanced vortex tube according to the invention comprises a vortex tube 312 with the throttle on the far end of the slender tube, fins 314 attached to the slender tube's outer side, a shell 316, which encloses a finned slender tube thus forming an outer wall of the heat exchanger 322, a liquid/gas separator 360 connected with the vortex tube's hot fraction outlet and a heat exchanger 380 connected with the vortex tube's inlet.

An assembly 70 which is also a Low Temperature Separation layout may be used for any gas composition treatment, providing there is at least one component in the mixture which vapor might be condensed in the chilled vortex flow. However, the main area of the present embodiment application is an oil and gas industry.

A high pressure hydrocarbonaceous mixture enters assembly 70 through a heat exchanger 380 where gas is cooled by the vortex tube's outlet flow. Then the high pressure gas through line 384 enters vortex tube 312 where it undergoes an energy separation. A chilled vortex tube's cold fraction with low hydrocarbon/water dew point and low sour components content (if any) leaves the vortex tube through a diaphragm. A hot flow enriched with the liquid condensed in the vortex central layers as well as with the $H_2S$ and/or $CO_2$ (if any) absorbed by the chilled condensed liquid leaves vortex tube through throttle and is then directed into separator 360 for phase separation and further treatment.

A conditioned cold fraction leaving the vortex tube's diaphragm is then divided into two parts. One part through a valve 381 set up to maintain a desirable flow split is directed to the heat exchanger 322 to cool down the vortex tube's walls, another part through a valve 382 is directed to the heat exchanger 380 to cool down an inlet gas flow. After performing a cooling duty, both 'cold' flows are combined and directed for utilization.

If there is water available, it may be used entirely or with the vortex tube's cold fraction as was described above for the inlet gas/vortex walls cooling. As in the embodiment 3, a hydrocarbonaceous liquid or amine may be injected into vortex inlet flow. An injection device 390 connected with vortex tube 312 is included into assembly 70.

As cleared noted in connection with FIGS. 1 and 2, the heat exchanger's 222 and 322 inlet and outlet are interchangeable.

The embodiments in FIGS. 3 and 4 can be done both with and without a separator and with or without a heat exchanger 280 or 380.

While there has been shown and described what is considered to be the preferred embodiment of the patent disclosure, various changes and modifications may be made therein without departing from the scope of the invention.

It should be noted that a document disclosure no. 422837 was filed on Aug. 11, 1997 by the inventors of this application.

What is claimed is:

1. A method of heat transfer enhancement in a vortex tube harnessed in a system including a vortex tube with its slender tube plugged at the far end, fins attached to the slender tube's outer side and a shell, comprising the steps of:

a) enclosing the finned vortex slender tube with the shell, thus forming an outer wall of a heat exchanger;

b) connecting a vortex tube's inlet with a source of compressed gas and then discharging a gas flow through a vortex tube's diaphragm, thus providing for the gas flow to undergo an energy separation in the vortex tube; and c) connecting a separate gas flow with a heat exchanger inlet and then discharging this flow from a heat exchanger outlet, thus providing for the vortex flow to cool down and for the heat exchanger's flow to heat up.

2. The method of claim 1, including using a liquid as a separate flow in the heat exchanger to cool down the vortex flow and pick up the heat.

3. The method of claim 2, including injecting water into the vortex tube inlet.

4. A method of heat transfer enhancement in a vortex tube harnessed in a system including a vortex tube with its slender tube plugged at the far end, fins attached to the slender tube's outer side and a shell, comprising the steps of:

a) enclosing the finned vortex slender tube with the shell, thus forming an outer wall of a heat exchanger;

b) connecting a vortex tube's inlet with a source of compressed gas and then discharging the gas flow through a vortex tube's diaphragm, thus providing for the gas flow to undergo an energy separation in the vortex tube; and c) directing a portion of the gas flow downstream of a diaphragm discharge opening through an adjusting valve to a heat exchanger inlet and then discharging this flow from the heat exchanger, thus providing for the rest of the vortex flow gradually to cool down.

5. The method of claim 4, including using a liquid as a separate flow in the heat exchanger to cool down the vortex flow and pick up the heat.

6. The method of claim 4, including injecting water into the vortex tube inlet.

7. A method of heat transfer enhancement in a vortex tube operating with a condensate in a chilled vortex flow gas mixture's components, the method being harnessed in a system including a preliminary heat exchanger, a separator, a vortex tube with its slender tube plugged at the far end, fins attached to the slender tube's outer side and a shell, comprising the steps of:

a) enclosing the finned vortex slender tube with the shell, thus forming an outer wall of a heat exchanger;

b) connecting a preliminary heat exchanger inlet with a source of a compressed gas;

c) connecting a vortex tube's inlet with an outlet of the preliminary heat exchanger and then discharging the gas flow through an vortex tube's diaphragm, thus providing for the gas flow to undergo an energy separation in the vortex tube; and d) directing a gas flow downstream of a diaphragm discharge opening to the separator to recover a condensed liquid and prevent it from entering the heat exchanger.

8. The method of claim 7, including e) directing a portion of a gas flow exiting separator through an adjusting valve to the heat exchanger inlet and then discharging this flow from the heat exchanger, thus providing for the flow in the vortex tube gradually to cool down;

f) directing another portion of the gas flow exiting separator through an adjusting valve to the preliminary heat exchanger inlet and then discharging this flow from the preliminary heat exchanger, thus, also providing for the flow in the vortex tube gradually to cool down; and g) connecting the gas flow exiting from both said heat exchangers.

9. The method of claim 8, wherein hydrocarbonaceous liquid is injected into the vortex tube's inlet.

10. The method of claim 8, wherein liquid amine is injected into the vortex tube's inlet.

11. The method of claim 7, including (e) directing a gas flow exiting separator to the heat exchanger inlet and then discharging this flow from the heat exchanger, thus providing for the flow in the vortex tube to gradually cool down; and (f) directing a gas flow exiting heat exchanger to the preliminary heat exchanger's inlet and then discharging this flow from the preliminary heat exchanger, thus, also providing for the flow in the vortex tube to gradually cool down.

12. The method of claim 11, wherein hydrocarbonaceous liquid is injected into the vortex tube's inlet.

13. The method of claim 11, wherein liquid amine is injected into the vortex tube's inlet.

14. A method of heat transfer enhancement in a vortex tube operating with condensate in the chilled vortex flow gas mixture's components, the method being harnessed in a system including a preliminary heat exchanger, a separator, a vortex tube with its slender tube having a throttle valve at its far end, fins attached to the slender tube's outer side and a shell, comprising the steps of:

a) enclosing the finned vortex slender tube with the shell, thus forming an outer wall of a heat exchanger;

b) connecting a preliminary heat exchanger inlet with a source of compressed gas;

c) connecting a vortex tube's inlet with an outlet of the preliminary heat exchanger and then discharging the gas flow through a vortex tube's diaphragm, thus providing for the gas flow to undergo an energy separation in the vortex tube;

d) directing a portion of the gas flow exiting from a diaphragm discharge opening through an adjusting valve to a heat exchanger inlet and then discharging this flow from the heat exchanger, thus providing for the flow in the vortex tube gradually to cool down;

e) directing another portion of the gas flow exiting from the diaphragm discharge opening through an adjusting valve to the preliminary heat exchanger's inlet and then discharging this flow from the preliminary heat exchanger, thus also providing for the flow in the vortex tube gradually to cool down;

f) combining gas flows exiting from both said heat exchangers; and g) directing a gas flow downstream of the throttle valve to the separator to recover a condensed liquid.

15. The method of claim 14, wherein hydrocarbonaceous liquid is injected into the vortex tube's inlet.

16. The method of claim 14, wherein liquid amine is injected into the vortex tube's inlet.

* * * * *